US006725768B1

(12) United States Patent
Cushing

(10) Patent No.: US 6,725,768 B1
(45) Date of Patent: Apr. 27, 2004

(54) METHOD AND APPARATUS FOR CRUSHING CANS

(76) Inventor: Darrell D. Cushing, 1119 E. Secretariat Dr., Danville, KY (US) 40422

( * ) Notice: Subject to any disclaimer, the term of this patent is extended or adjusted under 35 U.S.C. 154(b) by 14 days.

(21) Appl. No.: 10/267,135

(22) Filed: Oct. 10, 2002

Related U.S. Application Data

(60) Provisional application No. 60/371,623, filed on Apr. 11, 2002.

(51) Int. Cl.[7] ..... B30B 13/00

(52) U.S. Cl. ..... 100/35; 100/233; 100/293; 100/902

(58) Field of Search ..... 100/214, 215, 100/280, 293, 902, 233, 35; 241/99

(56) References Cited

U.S. PATENT DOCUMENTS

| | | | | |
|---|---|---|---|---|
| 3,988,978 A | | 11/1976 | Flick | |
| 4,261,259 A | * | 4/1981 | Beardslee | 100/152 |
| 4,291,618 A | * | 9/1981 | Heiser et al. | 100/35 |
| 4,292,891 A | | 10/1981 | Shelley | |
| 4,358,994 A | | 11/1982 | Talley | |
| 4,383,480 A | | 5/1983 | Jerden | |
| 4,653,398 A | | 3/1987 | Fowler | |
| 4,884,502 A | | 12/1989 | Stacey, Jr. | |
| 5,094,157 A | * | 3/1992 | Challis et al. | 100/345 |
| 5,158,013 A | | 10/1992 | Morris | |
| 5,333,542 A | | 8/1994 | Lewis et al. | |
| 5,454,305 A | * | 10/1995 | Becker | 100/137 |
| 5,469,785 A | | 11/1995 | Goings | |
| 5,584,239 A | | 12/1996 | Yelczyn et al. | |
| 5,794,527 A | | 8/1998 | Brooks | |
| 6,138,558 A | | 10/2000 | Harrington | |

* cited by examiner

*Primary Examiner*—Allen Ostrager
*Assistant Examiner*—Shelley Self
(74) *Attorney, Agent, or Firm*—Frank C. Leach, Jr.

(57) ABSTRACT

The lowermost of a plurality of vertically stacked cans, which have their longitudinal axes substantially vertical, is held at a first stop. A crush plate is advanced to have a first portion of its front wall engage a mid portion of the lowermost can to fold it about an axis perpendicular to its longitudinal axis. When the crush plate is withdrawn, the lowermost can falls to a second lower stop and the next stacked can is held at the first stop. The crush plate has the first portion of its front wall engage the next can to fold it and a second portion of its front wall engage the entire surface of the folded can to flatten it to enable the flattened can to exit past the second stop.

20 Claims, 7 Drawing Sheets

METHOD AND APPARATUS FOR CRUSHING CANS

This application claims the benefit of U.S. Provisional application No. 60/371,623, filed Apr. 11, 2002.

This invention relates to a method and apparatus for crushing vertically stacked cans and, more particularly, to a method and apparatus for crushing vertically stacked cans having their longitudinal axes substantially vertical through applying forces substantially perpendicular to the longitudinal axis of each can.

It has previously been suggested to crush cans, particularly elongated aluminum cans used for soft drinks, to reduce their size so that the cans can be easily recycled without utilizing a tremendous volume of space for storage and transportation to a recycling center.

One previous suggestion has been to crush the can along its longitudinal axis. However, this requires a significant force. It also does not permit any vertical stacking of the cans so that crushing a plurality of cans is time consuming.

Another prior suggested apparatus has used a complex mechanical apparatus in which the crushing force is applied by an electric motor. While this apparatus has enabled the cans to be vertically stacked, it is relatively expensive and not financially practical for most individuals to purchase for home use in particular.

The can crusher of the present invention has the cans vertically stacked on top of each other but does not require a complex mechanism or an electric motor for applying the force to crush the can. Instead, the can crusher has the cans disposed in a vertically stacked relation and initially folds the lowermost can about an axis substantially perpendicular to its substantially vertical longitudinal axis at a first vertical position.

Then, the folded can falls to a second and lower vertical position where it is flattened through a force being applied substantially perpendicular to its substantially vertical longitudinal axis. At the same time that the lowermost can, which is now folded, is being flattened, the next of the vertically stacked cans is folded at the first vertical position.

Accordingly, the can crusher is capable of crushing a relatively large number of cans in a relatively short period of time with a relatively small applying force required by a user. The can crusher is relatively inexpensive so that it may be easily purchased by an individual seeking to recycle cans.

This invention relates to a method of crushing a plurality of vertically disposed cans vertically stacked on each other in which each can has its longitudinal axis substantially vertical. The method comprises holding the lowermost of the vertically stacked cans at a first vertical position with its longitudinal axis substantially vertical and applying a force to the can held at the first vertical position at its mid portion in a direction substantially perpendicular to its longitudinal axis to fold the can about its mid portion on an axis substantially perpendicular to its longitudinal axis. The folded can moves from the first vertical position to a second vertical position lower than the first vertical position after the applied force is removed while the can vertically above the folded can moves to the first vertical position with the folded can held at the second vertical position and the can vertically above the folded can held at the first vertical position. A force is applied to the folded can at the second vertical position over its entire surface in the direction substantially perpendicular to its longitudinal axis to flatten the folded can to reduce its thickness so that it is substantially flat and a force is applied to the can at the first vertical position at its mid portion in a direction substantially perpendicular to its longitudinal axis to fold the can at the first vertical position about its mid portion on an axis substantially perpendicular to its longitudinal axis with the flattened can falling from the second vertical position after the applied force is removed therefrom.

This invention also relates to an apparatus for crushing a plurality of vertically disposed cans vertically stacked on each other in which each can has its longitudinal axis substantially vertical. The apparatus comprises a body having a substantially vertical passage for receiving a plurality of vertically stacked cans with each can having its longitudinal axis substantially vertical. The body has a first stop extending into the substantially vertical passage for a first predetermined distance to engage the lowermost of the vertically stacked cans at its bottom surface to stop its downward fall in the substantially vertical passage to hold the lowermost of the vertically stacked cans at a first vertical position. A movable force applying member is supported by the body for movement from its home position into the substantially vertical passage until at least one of the vertically stacked cans is engaged and for return from its can engaging position in the substantially vertical passage to its home position. The movable force applying member has a first portion for engaging the can at the first vertical position at its mid portion when the movable force applying member is moved from its home position sufficiently into the substantially vertical passage to apply a force to the mid portion of the can in a direction substantially perpendicular to the longitudinal axis of the can to fold the can about an axis substantially perpendicular to its longitudinal axis and reduce its thickness so that the folded can falls downwardly in the substantially vertical passage past the first stop when the movable force applying member is withdrawn from engagement with the folded can. The body has a second stop lower than the first stop with the second stop extending into the substantially vertical passage for a second predetermined distance greater than the first predetermined distance to stop the folded can at a second vertical position when the folded can falls downwardly in the substantially vertical passage past the first stop after the movable force applying member is withdrawn from engagement with the folded can. The first stop stops downward motion of the next can of the vertically stacked cans after the folded can is no longer at the first vertical position with the first stop holding the next can at the first vertical position. The movable force applying member has a second portion, lower than the first portion, for engaging the folded can over its entire surface at the second vertical position when the movable force applying member is moved from its home position sufficiently into the substantially vertical passage to apply a force to the folded can in the direction substantially perpendicular to the longitudinal axis of the folded can to flatten the folded can to a thickness to enable the flattened can to fall past the second stop when the movable force applying member is removed from engagement with the flattened can during return to its home position with the second portion of the movable force applying member applying a force during the same movement of the movable force applying member as when the first portion of the movable force applying member applies a force to the next can at the first vertical position.

The attached drawings illustrate a preferred embodiment of the invention, in which.

Figure 1:
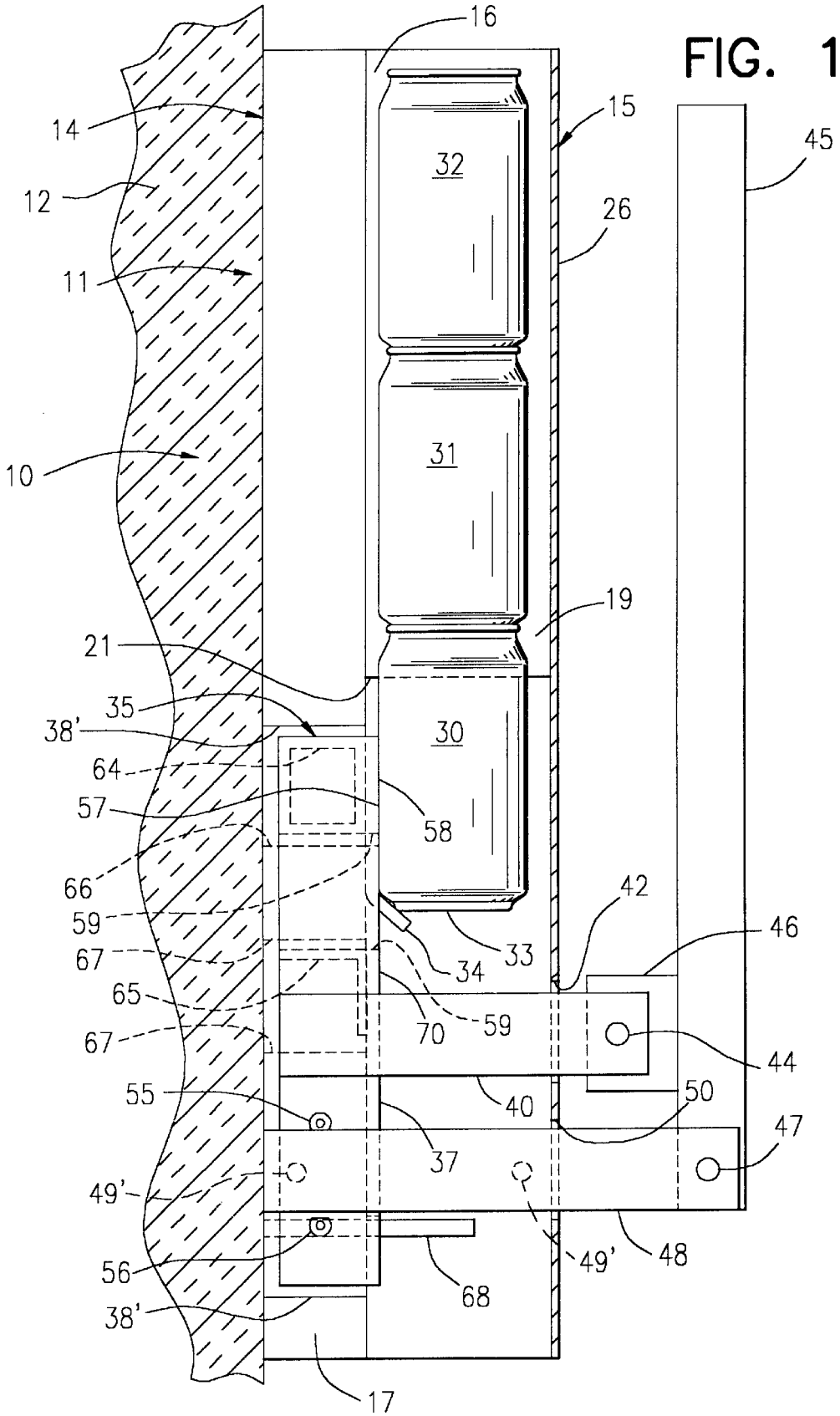
FIG. 1 is a side elevational view, partly in section, of a can crusher of the present invention supported on a wall with adjacent side walls of a back plate and a cover of the can crusher removed for clarity purposes and showing the lowermost of three vertically stacked cans held at a first vertical position with the crush plate at its home position.
Figure 2:
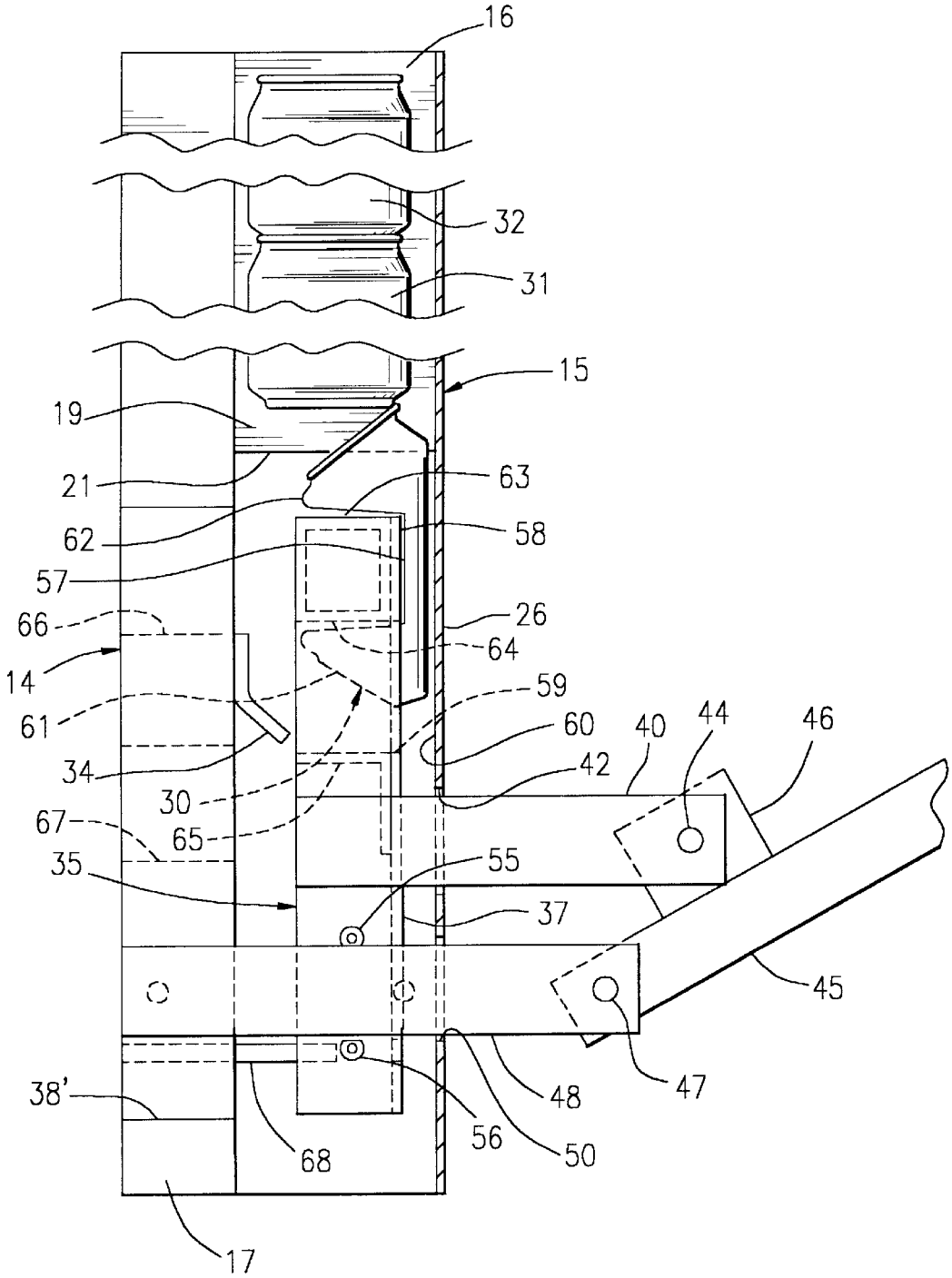
FIG. 2 is a fragmentary side elevational view, partly in section, of the can crusher, similar to FIG. 1, and showing the lowermost of the vertically stacked cans held at a first vertical position folded by the crush plate advanced to its can engaging position.
Figure 3:
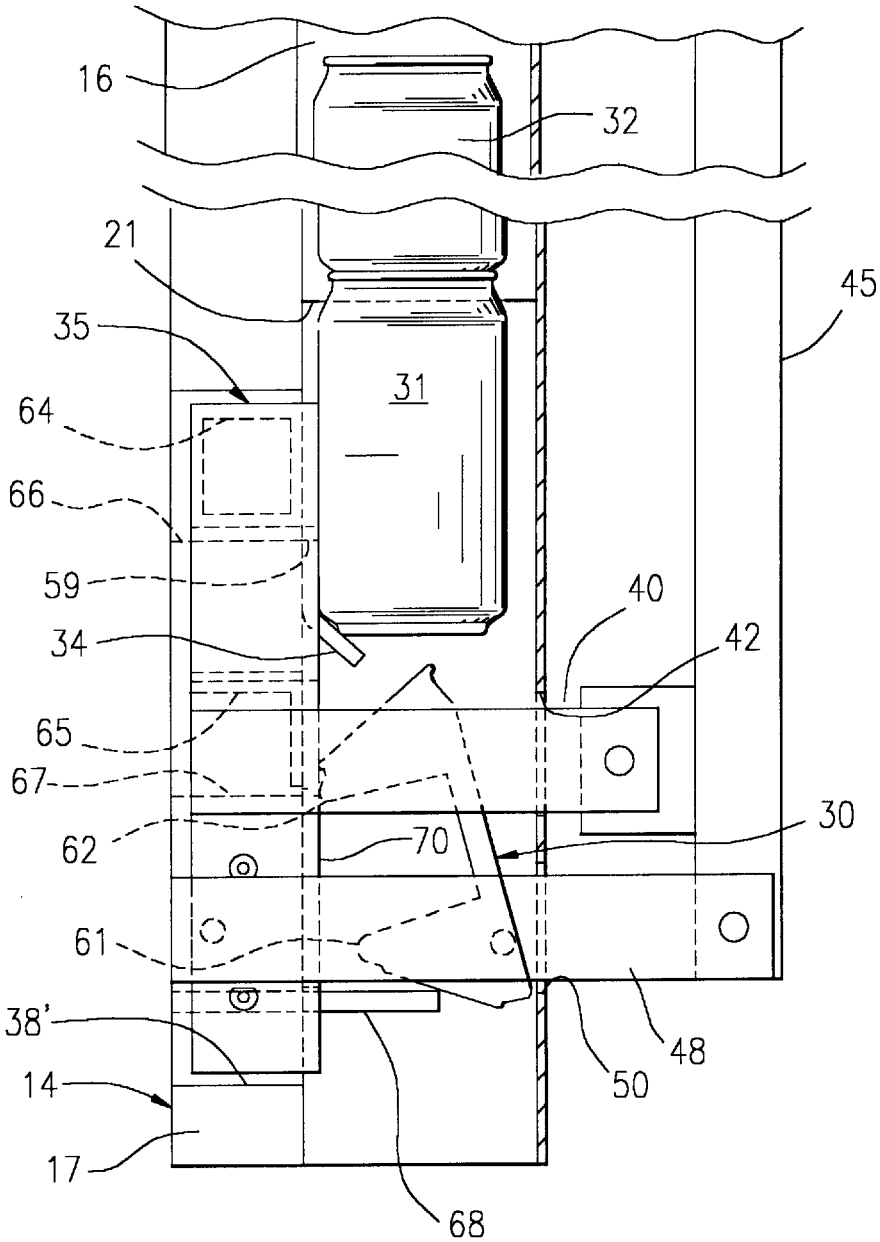
FIG. 3 is a fragmentary side elevational view, partly in section, of the can crusher, similar to FIGS. 1 and 2, and showing the second of the three vertically stacked cans held at the first vertical position with the lowermost can held in a second and lower vertical position after being folded by the crush plate and the crush plate returned to its home position.
Figure 4:
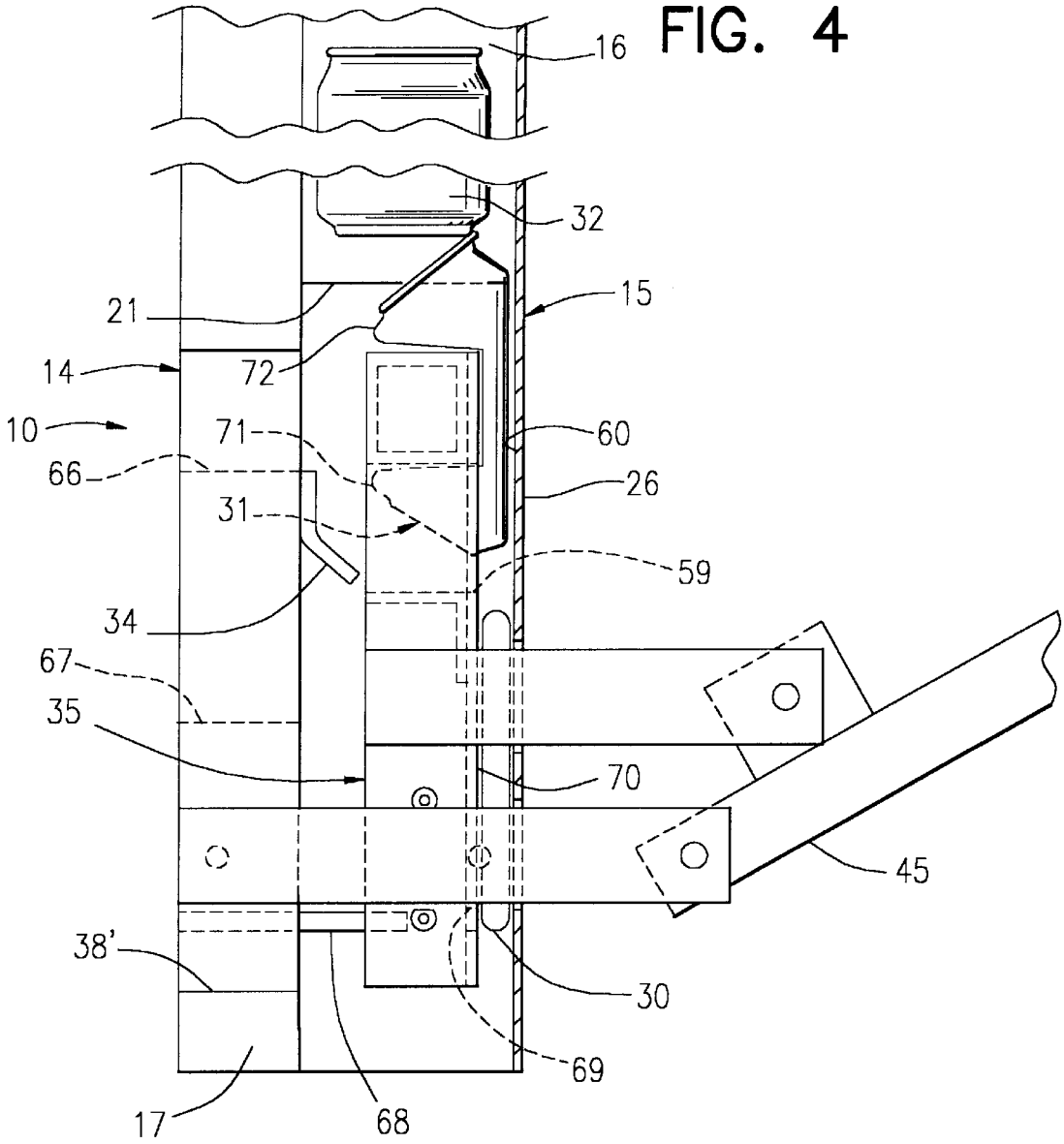
FIG. 4 is a fragmentary side elevational view, partly in section, of the can crusher, similar to FIGS. 1–3, and showing the second of the vertically stacked cans at the first vertical position being folded and the lowermost can being flattened at the second vertical position by the same advancement of the crush plate to its can engaging position.
Figure 5:
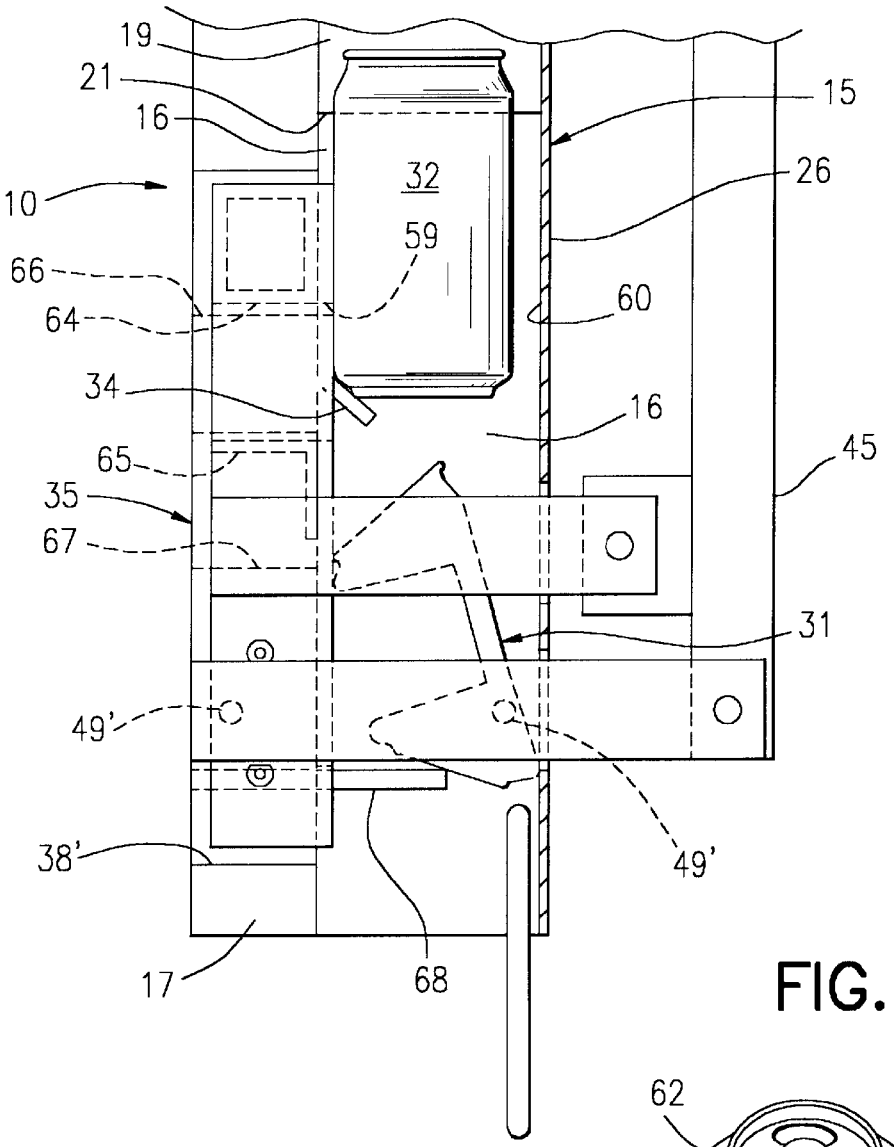
Figure 10:
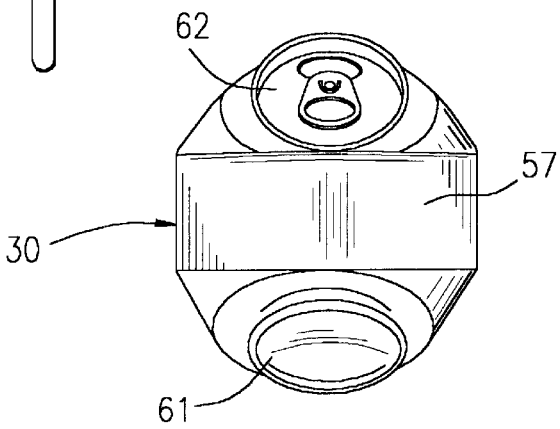
Figure 7:
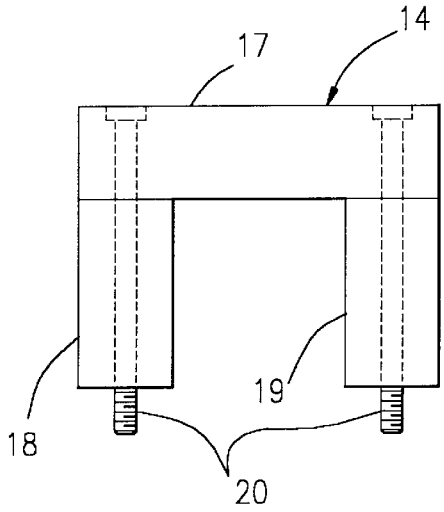
Figure 6:
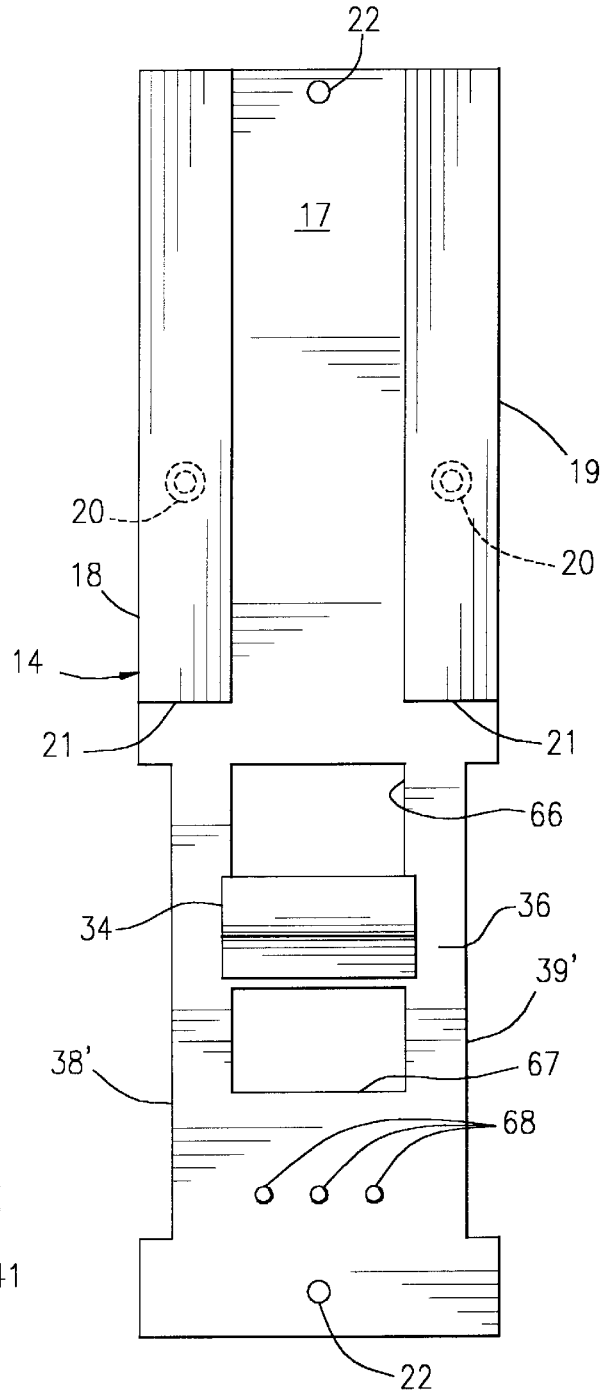
Figure 9:
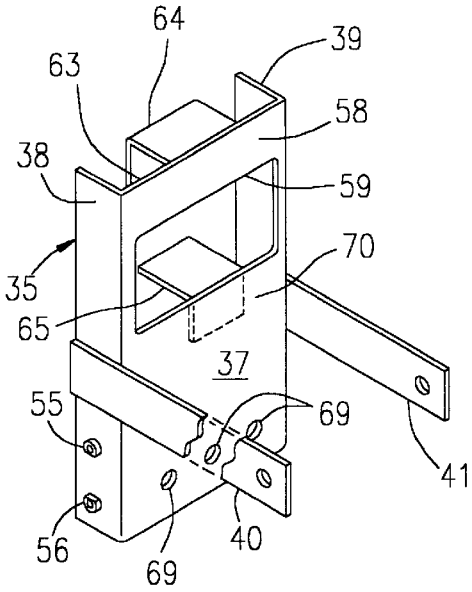
Figure 8:
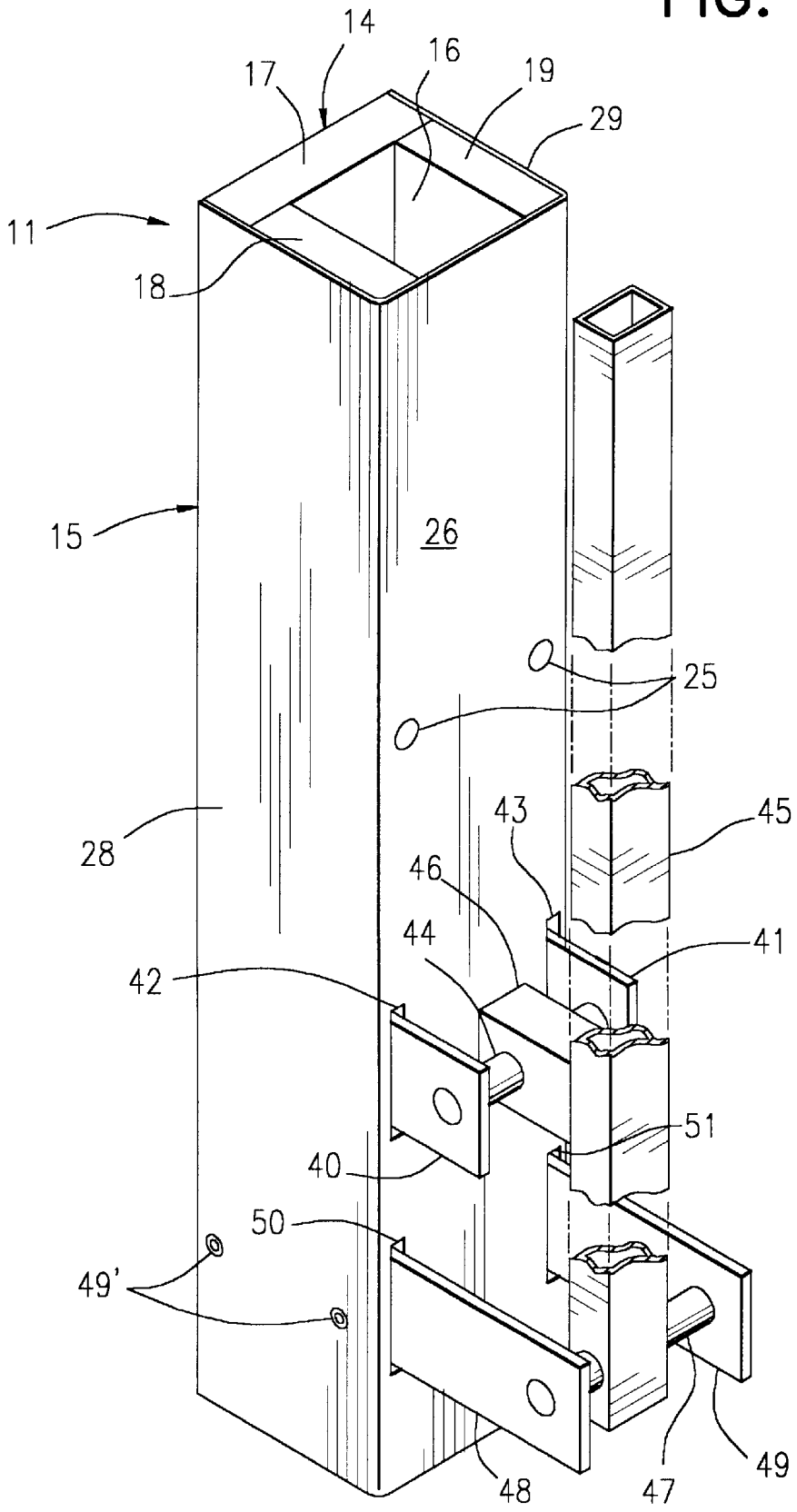

FIG. 5 is a fragmentary side elevational view, partly in section, of the can crusher, similar to FIGS. 1–4, and showing the uppermost of the three vertically stacked cans in FIG. 1 held at the first vertical position with the second can held at the second vertical position after being folded by the crush plate and the flattened can exiting the can crusher with the crush plate returned to its home position;

FIG. 6 is a front elevational view of a back plate of a body of the can crusher;

FIG. 7 is a top plan view of the back plate of FIG. 6;

FIG. 8 is a front perspective view of a cover attached to the back plate to form the body of the can crusher;

FIG. 9 is a front perspective view of the crush plate of the can crusher; and FIG. 10 is an elevational view of the folded can of FIG. 2 taken at 90° to FIG. 2.

Referring to the drawings and particularly FIG. 1, there is shown a can crusher 10 having a body 11 for mounting on a fixed support wall 12. The body 11 includes a U-shaped back plate 14 (see FIG. 8), which is preferably wood although it could be metal, and a U-shaped cover 15, which is preferably metal, attached to each other to form a rectangular shaped vertical passage 16 extending through the body 11.

The U-shaped back plate 14 includes a base 17 (see FIG. 7) having a pair of relatively thick side walls 18 and 19 extending substantially perpendicularly therefrom and substantially parallel to each other. Screws 20 extend through the base 17 and through each of the relatively thick side walls 18 and 19 to connect the side walls 18 and 19 to the base 17. As shown in FIG. 6, the side walls 18 and 19 terminate about half of the length of the base 17 at edges 21.

The base 17 of the back plate 14 has two mounting holes 22 to receive screws (not shown) for attaching the body 11 to the fixed support wall 12 (see FIG. 1). Any other suitable means may be employed for attaching the body 11 to the fixed support wall 12 or any other suitable means may be utilized to maintain the body 11 substantially vertical.

The cover 15 (see FIG. 8) has mounting holes 25 in its base 26. As shown in FIG. 7, the screws 20 extend beyond the ends of the side walls 18 and 19 for disposition in the mounting holes 25 (see FIG. 8) in the base 26 of the cover 15 to connect the back plate 14 (see FIG. 7) and the cover 15 (see FIG. 8) to each other.

The cover 15 has substantially parallel side walls 28 and 29 integral with the base 26 and substantially perpendicular thereto. The side walls 28 and 29 overlap the thick side walls 18 and 19 of the back plate 14 and the sides of the base 17 of the back plate 14. The cover 15 extends for the same length as the base 17 of the back plate 14 extends. However, as previously mentioned, the thick side walls 18 and 19 of the back plate 14 terminate at the edges 21 as shown in FIG. 6.

Thus, the portion of the vertical passage 16 (see FIG. 8) beneath the side walls 18 and 19 of the back plate 14 is formed by the side walls 28 and 29 of the cover 15, the base 17 of the back plate 14, and the base 26 of the cover 15. This portion of the vertical passage 16 has a larger cross sectional area.

As shown in FIG. 1, elongated cans 30, 31, and 32 are vertically stacked in the vertical passage 16 of the body 11 with the longitudinal axis of each of the cans 30–32 being substantially vertical. The lowermost can 30 has its bottom surface 33 engaging an angled stop 34, which is preferably formed of metal.

The stop 34 is attached to the base 17 (see FIG. 6) of the back plate 14 and has its angled portion extend for a first predetermined distance into the vertical passage 16 (see FIG. 1). The stop 34 initially holds or retains the lowermost can 30 of the vertically stacked cans 30–32 at a first vertical position.

A U-shaped crush plate 35 (see FIG. 9) is positioned within the U-shaped cover 15 (see FIG. 1) between the side walls 28 (see FIG. 8) and 29 of the cover 15 below the bottom edge 21 (see FIG. 6) of each of the side walls 18 and 19 of the back plate 14. The larger cross sectional area of the vertical passage 16 (see FIG. 1) accommodates the crush plate 35 at its home position when the crush plate 35 engages a reduced portion 36 (see FIG. 6) of the base 17 of the back plate 14.

The crush plate 35 (see FIG. 9) includes a front wall 37 and a pair of substantially parallel side walls 38 and 39 extending substantially perpendicular therefrom and integral therewith. The side walls 38 and 39 are slidably disposed in recesses 38' (see FIG. 6) and 39', respectively, which are formed on opposite sides of the base 17 by the reduced portion 36 of the base 17 of the back plate 14.

The crush plate 35 (see FIG. 9) has a pair of substantially parallel guide fingers 40 and 41 attached to the side walls 38 and 39, respectively, and extending forwardly beyond the front wall 37. As shown in FIG. 8, the guide fingers 40 and 41 extend through vertical slots 42 and 43, respectively, in the base 26 of the cover 15.

A pivot pin 44 extends between the guide fingers 40 and 41 exterior of the cover 15 of the body 11. A handle 45 has a block 46 (see FIG. 1) attached thereto and pivotally mounted on the pivot pin 44 between the guide fingers 40 and 41 (see FIG. 8).

The handle 45 has its lower end pivotally mounted on a pivot pin 47 supported between a pair of substantially parallel plates 48 and 49. Each of the plates 48 and 49 is fixed to the side walls 28 and 29, respectively, of the cover 15 by two separate bolts 49' as shown in FIG. 8 for the plate 48.

The plates 48 and 49 extend through vertical slots 50 and 51, respectively, in the base 26 of the cover 15. Clockwise (as viewed in FIGS. 1 and 2) pivoting of the handle 45 moves the crush plate 35 from its home position of FIG. 1 to its can engaging position of FIG. 2.

The crush plate 35 has a separate upper guide pin 55 (see FIG. 9) fixed to the exterior of each of the side walls 38 and 39 and a separate lower guide pin 56 fixed to the exterior of each of the side walls 38 and 39. As shown in FIG. 1 for the plate 48, each of the two separate upper guide pins 55 rides along top surface of each of the plates 48 and 49 (see FIG. 8) during movement of the crush plate 35 (see FIG. 1) by pivoting of the handle 45. Each of the two separate lower guide pins 56 prevents upward movement of the crush plate 35.

Each of the two separate upper guide pins 55 has a flat bottom surface for riding along the top surface of each of the plates 48 and 49 (see FIG. 8) during movement of the crush plate 35 (see FIG. 1). Each of the two separate lower guide pins 56 has a flat upper surface slightly spaced from bottom surface of the plates 48 and 49 (see FIG. 8).

When the handle 45 is pivoted clockwise (as viewed in FIG. 1) to advance the crush plate 35 from its home position of FIG. 1 to its can engaging position of FIG. 2 in a direction substantially perpendicular to the longitudinal axis of the can 30, a mid portion 57 (see FIG. 2) of the can 30 is engaged by an upper portion 58 (see FIG. 9) of the front wall 37 of the crush plate 35. The upper portion 58 is the portion of the front wall 37 above a rectangular shaped opening 59 in the front wall 37 of the crush plate 35. The opening 59 allows the stop 34 (see FIG. 1) to pass therethrough as the crush plate 35 moves to the position of FIG. 2.

The advancement of the crush plate 35 to the position in FIG. 2 pushes the can 30 against inner surface 60 of the base 26 of the cover 15 to fold the can 30 to produce a lower portion 61 and an upper portion 62 between the mid portion 57 of the can 30. The mid portion 57 is relatively flat between the lower portion 61 and the upper portion 62 of the folded can 30 because of its engagement by the upper portion 58 (see FIG. 9) of the front wall 37 of the crush plate 35. The folding of the can 30 (see FIG. 2) is about an axis substantially perpendicular to its longitudinal axis.

The opening 59 (see FIG. 9) in the front wall 37 of the crush plate 35 receives the lower portion 61 (see FIG. 2) of the folded can 30, which also is shown in FIG. 10. The upper portion 62 of the folded can 30 extends over top surface 63 (see FIG. 9) of the front wall 37 of the crush plate 35 as shown in FIG. 2.

A square shaped tube 64 (see FIG. 9) is mounted on the back of the front wall 37 to prevent the upper portion 62 (see FIG. 2) of the folded can 30 from tilting downwardly about the top surface 63 (see FIG. 9) of the front wall 37 of the crush plate 35 so as to be retained behind the crush plate 35 with the crush plate 35 in its can engaging position. This would prevent downward movement of the folded can 30 (see FIG. 2) when the crush plate 35 is withdrawn from engagement with the folded can 30 through holding the folded can 30 on the crush plate 35.

An angle iron 65 (see FIG. 9) is mounted on the back of the front wall 37 below the opening 59. This prevents the lower portion 61 (see FIG. 2) of the folded can 30 from being retained behind the crush plate 35 after the crush plate 35 is removed from engagement with the folded can 30. This also would prevent downward movement of the folded can 30 when the crush plate 35 is withdrawn from engagement with the folded can 30 through holding the folded can 30 on the crush plate 35.

The reduced portion 36 (see FIG. 6) of the base 17 of the back plate 14 has an opening 66 above the stop 34 to receive the square shaped tube 64 (see FIG. 1) when the crush plate 35 is in its home position of FIG. 1. The reduced portion 36 (see FIG. 6) of the base 17 of the back plate 14 has an opening 67 below the stop 34 to receive the angle iron 65 (see FIG. 1) when the crush plate 35 is in its home position of FIG. 1.

The upper portion 62 (see FIG. 2) of the folded can 30 is at an angle so that only a substantially pointed portion of its top surface remains. This prevents the bottom of the can 31 from nesting within the conformed top surface of the folded can 30. This insures that there is no longer engagement of the can 31 with the folded can 30 to prevent downward movement of the folded can 30 after the crush plate 35 ceases to engage it.

The folded can 30 is reduced in size so that withdrawal of the crush plate 35 from its can engaging position of FIG. 2 to its home position of FIG. 3 results in the folded can 30 falling by gravity past the stop 34. The folded can 30 falls downwardly from the position of FIG. 2 until the lower portion 61 of the folded can 30 engages a plurality, preferably three, of substantially parallel stop pins 68 as shown in FIG. 3. The stop pins 68 are mounted in the base 17 of the back plate 14 and extend into the vertical passage 16 for a second predetermined distance substantially greater than the first predetermined distance that the stop 34 extends into the vertical passage 16.

The front wall 37 (see FIG. 9) of the crush plate 35 has a plurality of openings 69 in its lower portion 70 through which the stop pins 68 (see FIG. 1) extend. This allows the crush plate 35 to move between its home position and its can engaging position.

When the folded can 30 falls downwardly from the position of FIG. 2 after the crush plate 35 is withdrawn from engagement with the folded can 30 as the crush plate 35 is returned to its home position of FIG. 3 by counterclockwise pivoting of the handle 45, the can 31 falls downwardly by gravity until it engages the stop 34. The can 32 remains on the top of the can 31 when the can 31 engages the stop 34 because of the nesting arrangement of the bottom of the can 32 on top of the can 31.

When the handle 45 is pivoted clockwise from the position of FIG. 3 to the position of FIG. 4, the can 31 is folded by the crush plate 35 in the same manner as previously described for folding the can 30 so that the folded can 31 has a lower portion 71 and an upper portion 72. During the same advancement of the crush plate 35, the lower portion 70 (see FIG. 9) of the front wall 37 of the crush plate 35 is moved into engagement with the lower portion 61 (see FIG. 3) and the upper portion 62 of the folded can 30 to flatten the folded can 30 to its relatively thin, flat shape of FIG. 4.

Thus, the entire surface of the folded can 30 of FIG. 3 is engaged by the lower portion 70 (see FIG. 9) of the front wall 37 of the crush plate 35 as the crush plate 35 is advanced from the position of FIG. 3 to the position of FIG. 4. This significantly reduces the thickness of the folded can 30. Accordingly, the flattened can 30 can fall between the ends of the stop pins 68 and the inner surface 60 of the base 26 of the cover 15 to the position of FIG. 5 to exit the can crusher 10 when the crush plate 35 is withdrawn from engagement with the flattened can 30 by counterclockwise pivoting of the handle 45 from the position of FIG. 4 to the position of FIG. 5.

With the handle 45 returned to the position of FIG. 5, the folded can 31 falls into engagement with the stop pins 68, and the can 32, which was the uppermost can in the initial stack of the cans 30–32, engages the stop 34. With the cans 31 and 32 in the position of FIG. 5, clockwise pivoting of the handle 45 to a position corresponding to FIG. 4 flattens the folding can 31 to the same relatively thin, flat shape as the flattened can 30. Then, the handle 45 is pivoted to a position corresponding to FIG. 5 so that the can 32 falls to the position of the can 31 in FIG. 5 when the crush plate 35 is withdrawn from engagement with the folded can 32. The can 32 will have been folded during the same advancement of the crush plate 35 that flattens the folded can 31 in the same manner as shown in FIG. 4 for the cans 30 and 31.

If there is no can above the can 32, then only the folded can 32 is acted on by the crush plate 35 during the next and final movement of the crush plate 35 from its home position. This flattens the can 32 in the same manner as each of the cans 30 and 31 was flattened.

Thus, in the first cycle of operation, there is only folding of the lowermost can 30 of the vertically stacked cans 30–32 in the vertical passage 16 as shown in FIG. 2. In the last cycle of operation, there is only flattening of the initial uppermost can 32. During the other cycles of operation, there is flattening of the folded can, which is the lower of the two cans being engaged by the crush plate 35, and folding of the upper of the two cans being engaged during the same advancement of the crush plate 35 as shown in FIG. 4.

Therefore, the stop 34, which extends the first predetermined distance into the vertical passage 16, holds each of the cans at the first vertical position for folding. Then, the stop pins 68, which extend the second predetermined distance substantially greater than the first predetermined distance into the vertical passage 16, hold each of the folded cans 30–32 at the second vertical position to be flattened by the crush plate 35. After the first cycle of operation, both flattening of a folded can and folding of the next upper can of the vertically stacked cans occur during each cycle of operation except for the last can with folding beginning slightly before flattening.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A method of crushing a plurality of vertically disposed cans vertically stacked on each other in which each can has its longitudinal axis substantially vertical comprising:

holding the lowermost of the vertically stacked cans at a first vertical position with its longitudinal axis substantially vertical;

applying a force to the can held at the first vertical position at its mid portion in a direction substantially perpendicular to its longitudinal axis to fold the can about its mid portion on an axis substantially perpendicular to its longitudinal axis, the folded can moving from the first vertical position to a second vertical position lower than the first vertical position after the applied force is removed while the can vertically above the folded can moves to the first vertical position;

holding the folded can at the second vertical position;

holding the can vertically above the folded can at the first vertical position;

and applying a force to the folded can at the second vertical position over its entire surface in the direction substantially perpendicular to its longitudinal axis to flatten the folded can to reduce its thickness so that it is substantially flat and a force to the can at the first vertical position at its mid portion in a direction substantially perpendicular to its longitudinal axis to fold the can at the first vertical position about its mid portion on an axis substantially perpendicular to its longitudinal axis, the flattened can falling from the second vertical position after the applied force is removed therefrom.

2. The method according to claim 1 in which each of the folded cans moves from the first vertical position to the second vertical position lower than the first vertical position by falling by gravity after each of the cans has been folded about its mid portion and the applied force is removed.

3. The method according to claim 2 in which each of the flattened cans falls from the second vertical position by gravity after the applied force is removed.

4. An apparatus for crushing a plurality of vertically disposed cans vertically stacked on each other in which each can has its longitudinal axis substantially vertical comprising:

a body having a substantially vertical passage for receiving a plurality of vertically stacked cans with each can having its longitudinal axis substantially vertical;

said body having a first stop extending into said substantially vertical passage for a first predetermined distance to engage the lowermost of the vertically stacked cans at its bottom surface to stop its downward fall in said substantially vertical passage to hold the lowermost of the vertically stacked cans at a first vertical position;

a movable force applying member supported by said body for movement from its home position into said substantially vertical passage until at least one of the vertically stacked cans is engaged and for return from its can engaging position in said substantially vertical passage to its home position;

said movable force applying member having a first portion for engaging the can at the first vertical position at its mid portion when said movable force applying member is moved from its home position sufficiently into said substantially vertical passage to apply a force to the mid portion of the can in a direction substantially perpendicular to the longitudinal axis of the can to fold the can about an axis substantially perpendicular to its longitudinal axis and reduce its thickness so that the folded can falls downwardly in said substantially vertical passage past said first stop when said movable force applying member is withdrawn from engagement with the folded can;

said body having a second stop lower than said first stop, said second stop extending into said substantially vertical passage for a second predetermined distance greater than the first predetermined distance to stop the folded can at a second vertical position when the folded can falls downwardly in said substantially vertical passage past said first stop after said movable force applying member is withdrawn from engagement with the folded can;

said first stop stopping downward motion of the next can of the vertically stacked cans after the folded can is no longer at the first vertical position, said first stop holding the next can at the first vertical position;

and said movable force applying member having a second portion, lower than said first portion, for engaging the folded can over its entire surface at the second vertical position when said movable force applying member is moved from its home position sufficiently in said substantially vertical passage to apply a force to the folded can in the direction substantially perpendicular to the longitudinal axis of the folded can to flatten the folded can to a thickness to enable the flattened can to fall past said second stop when said movable force applying member is removed from engagement with the flattened can during return to its home position, said second portion of said movable force applying member applying a force during the same movement of said movable force applying member as when said first portion of said movable force applying member applies a force to the next can at the first vertical position.

5. The apparatus according to claim 4 in which said body has moving means supported thereby for moving said movable force applying member from its home position to a can engaging position in said substantially vertical passage and for returning said movable force applying member from its can engaging position in said substantially vertical passage to its home position.

6. The apparatus according to claim 5 in which said moving means includes a handle supported by said body and connected to said movable force applying member.

7. The apparatus according to claim 5 in which said moving means includes a handle pivotally supported by said body and pivotally connected to said movable force applying member.

8. The apparatus according to claim 4 in which said first portion and said second portion of said movable force applying member are in the same vertical plane.

9. The apparatus according to claim 4 in which:

said movable force applying member comprises a substantially vertical wall;

said first portion of said movable force applying member comprises an upper portion of said substantially vertical wall;

said second portion of said movable force applying member comprises a lower portion of said substantially vertical wall;

and said substantially vertical wall has an opening between said upper portion and said lower portion to have said first stop pass therethrough during movement of said movable force applying member.

10. The apparatus according to claim 4 in which:

said movable force applying member comprises a U-shaped crush plate having a substantially vertical front wall and two substantially vertical side walls substantially perpendicular to said front wall and extending rearwardly therefrom;

said first portion of said movable force applying member comprises an upper portion of said front wall;

said second portion of said movable force applying member comprises a lower portion of said front wall;

and said front wall has an opening between said upper portion and said lower portion to have said first stop pass therethrough during movement of said movable force applying member.

11. The apparatus according to claim 10 comprising:

substantially parallel support plates extending from said body substantially perpendicular to said substantially vertical passage;

and a support pin extending from each of said side walls of said crush plate for riding along the upper surface of each of said support plates of said body during movement of said movable force applying member.

12. The apparatus according to claim 11 comprising:

a guide finger extending from each of said side walls of said crush plate forwardly of said front wall of said crush plate;

and said body comprising a substantially vertical wall having a pair of vertical slots therein to receive said guide fingers.

13. An apparatus for crushing a plurality of vertically disposed cans vertically stacked on each other in which each can has its longitudinal axis substantially vertical comprising:

a body comprising a U-shaped back plate and a U-shaped cover attached to each other;

said U-shaped back plate comprising:

a base;

and two side walls substantially perpendicular to said base and extending therefrom, said side walls having a shorter length than said base;

said U-shaped cover comprising:

a base of the same length as said base of said back plate;

and two side walls substantially perpendicular to said base and extending therefrom for the length of said base, said side walls overlapping said side walls of said back plate and the sides of said base of said back plate;

said body having a substantially vertical passage for receiving a plurality of vertically stacked cans with each can having its longitudinal axis substantially vertical;

said substantially vertical passage comprising:

an upper portion defined by said side walls of said back plate, said base of said back plate, and said base of said cover, said upper portion ending at the bottoms of said side walls of said back plate;

and a lower portion defined by said side walls of said cover, said base of said back plate, and said base of said cover, said lower portion having a larger cross sectional area than said upper portion;

said base of said back plate supporting a first stop extending into said lower portion of said substantially vertical passage for a first predetermined distance from said base of said back plate to engage the lowermost of the vertically stacked cans at its bottom surface to stop its downward fall in said substantially vertical passage to hold the lowermost of the vertically stacked cans at a first vertical position;

a movable force applying member disposed in said lower portion of said substantially vertical passage, said movable force applying member being supported by said side walls of said cover for movement from a home position sufficiently into said substantially vertical passage for engagement with the can at the first vertical position and for return to its home position;

said movable force applying member having a first portion for engaging the can at the first vertical position at its mid portion when said movable force applying member is moved from its home position sufficiently into said substantially vertical passage to apply a force to the mid portion of the can in a direction substantially perpendicular to the longitudinal axis of the can to fold the can about an axis substantially perpendicular to its longitudinal axis and reduce its thickness so that the folded can falls downwardly in said substantially vertical passage past said first stop when said movable force applying member is withdrawn from engagement with the folded can;

said base of said back plate supporting a second stop lower than said first stop, said second stop extending from said base of said back plate in said lower portion of said substantially vertical passage for a second predetermined distance greater than the first predetermined distance to stop the folded can at a second vertical position when the folded can falls downwardly in said substantially vertical passage past said first stop after said movable force applying member is withdrawn from engagement with the folded can;

said first stop stopping downward motion of the next can of the vertically stacked cans after the folded can is no longer at the first vertical position;

and said movable force applying member having a second portion, lower than said first portion, for engaging the folded can over its entire surface at the second vertical position when said movable force applying member is moved from its home position sufficiently into said substantially vertical passage to apply a force to the folded can in the direction substantially perpendicular to the longitudinal axis of the folded can to flatten the folded can to a thickness to enable the flattened can to fall past said second stop when said movable force applying member is removed from engagement with the flattened can, said second portion of said movable force applying member applying a force during the same movement of said movable force applying member as when said first portion of said movable force applying member applies a force to the next can at the first vertical position.

14. The apparatus according to claim 13 in which a handle is supported by said base of said back plate and connected to said movable force applying member.

15. The apparatus according to claim 13 in which a handle is pivotally supported by said base of said back plate and pivotally connected to said movable force applying member.

16. The apparatus according to claim 13 in which said first portion and said second portion of said movable force applying member are in the same vertical plane.

17. The apparatus according to claim 13 in which:

said movable force applying member comprises a substantially vertical wall;

said first portion of said movable force applying member comprises an upper portion of said substantially vertical wall;

said second portion of said movable force applying member comprises a lower portion of said substantially vertical wall;

and said substantially vertical wall has an opening between said upper portion and said lower portion to have said first stop pass therethrough during movement of said movable force applying member.

18. The apparatus according to claim 13 in which:

said movable force applying member comprises a U-shaped crush plate having a substantially vertical front wall and two substantially vertical side walls substantially perpendicular to said front wall and extending rearwardly therefrom;

said first portion of said movable force applying member comprises an upper portion of said front wall;

said second portion of said movable force applying member comprises a lower portion of said front wall;

and said front wall has an opening between said upper portion and said lower portion to have said first stop pass therethrough during movement of said movable force applying member.

19. The apparatus according to claim 18 comprising:

substantially parallel support plates extending from said side walls of said cover and substantially perpendicular to said substantially vertical passage;

and a support pin extending from each of said side walls of said crush plate for riding along the upper surface of each of said support plates of said side walls of said cover during movement of said movable force applying member.

20. The apparatus according to claim 19 comprising:

a guide finger extending from each of said side walls of said crush plate forwardly of said front wall of said crush plate;

and a pair of vertical slots in said base of said cover to receive said guide fingers.

* * * * *